US012146309B2

(12) United States Patent
Hsu

(10) Patent No.: US 12,146,309 B2
(45) Date of Patent: Nov. 19, 2024

(54) QUICK WATER DISCHARGING DEVICE OF TOILET TANK

(71) Applicant: HOKWANG INDUSTRIES CO., LTD., New Taipei (TW)

(72) Inventor: Chin-Chan Hsu, New Taipei (TW)

(73) Assignee: HOKWANG INDUSTRIES CO., LTD., New Taipei (TW)

( * ) Notice: Subject to any disclaimer, the term of this patent is extended or adjusted under 35 U.S.C. 154(b) by 99 days.

(21) Appl. No.: 18/091,710

(22) Filed: Dec. 30, 2022

(65) Prior Publication Data

US 2024/0218649 A1 Jul. 4, 2024

(51) Int. Cl.

| | |
|---|---|
| ***E03D 1/38*** | (2006.01) |
| ***E03D 1/34*** | (2006.01) |
| ***E03D 5/02*** | (2006.01) |

(52) U.S. Cl.

CPC ..... *E03D 1/38* (2013.01); *E03D 1/34* (2013.01); *E03D 5/026* (2013.01)

(58) Field of Classification Search

CPC ..... E03D 1/34; E03D 1/38; E03D 5/026

USPC ..... 4/378, 387–397, 400, 415, 417–418

See application file for complete search history.

(56) References Cited

U.S. PATENT DOCUMENTS

| | | | | |
|---|---|---|---|---|
| 1,887,295 A * | 11/1932 | Freed | E03D 9/14 | 4/378 |
| 5,218,725 A * | 6/1993 | Lipman | E03D 1/34 | 4/392 |
| 2003/0213054 A1* | 11/2003 | Huang | E03D 1/34 | 4/395 |

FOREIGN PATENT DOCUMENTS

| | | |
|---|---|---|
| CN | 2466254 Y | 12/2001 |
| CN | 103590467 A | 2/2014 |
| CN | 206503204 U | 9/2017 |

* cited by examiner

*Primary Examiner* — Tuan N Nguyen
(74) *Attorney, Agent, or Firm* — MUNCY, GEISSLER, OLDS & LOWE, P.C.

(57) ABSTRACT

A quick water discharging device of a toilet tank, including a water discharging structure including a main pipe and an overflow manifold communicating with an inner space of the main pipe; and a water stoppage structure including a rubber valve seat located at an end of the main pipe, and a water stoppage valve pivotally connected to the overflow manifold and fitted with the rubber valve seat. The main pipe includes a pipe body, the inclined surface, and a communication hole communicating with the overflow manifold. The rubber valve seat includes a seat body, an opening communicating with the main pipe, and at least one baffle extending from the seat body to the main pipe. The baffle is close to an inner wall of the main pipe, faces the communication hole, and covers at least 50% of an area of the communication hole.

15 Claims, 6 Drawing Sheets

QUICK WATER DISCHARGING DEVICE OF TOILET TANK

FIELD OF THE INVENTION

The invention relates to a quick water discharging device of a toilet tank, and more particularly to a quick water discharging device capable of reducing air resistance during water discharging.

BACKGROUND OF THE INVENTION

In the field of flush toilets, there are related water discharging structures such as overflow pipes, water discharging pipes, and water stoppage devices in the water tank, and a water stoppage valve is the main controller of water outlet from the water tank. The relevant content of the water discharging structures can be found in CN 206503204U, CN 2466254Y and CN 103590467A.

When the conventional water discharging structure is implemented, the water stoppage valve is operated to stop blocking the water discharging pipe from the outside, so that the water inside the water tank can flow toward the toilet through the water discharging pipe. However, the conventional water discharging structure has the problem that it is difficult for the water in the water tank to enter into the water discharging pipe. The reason is that one end of the overflow pipe is connected to the water discharging pipe, when the water stoppage valve is opened, the air in the overflow pipe flows toward the water discharging pipe under pressure and also discharges through opening of the water discharging pipe connected to the water stoppage valve. That is to say, when the water stoppage valve is opened, the water in the water tank will flow into the water discharging pipe, and the air in the overflow pipe will be discharged from the water discharging pipe, this will cause collision between the water flow and the air, which is not conducive to rapid flow of the water into the water discharging pipe.

Taking CN 206503204U as an example, in order to solve the above-mentioned problems, the structure of the water discharging valve is provided with a water baffle facing the outlet of the overflow channel. However, the object of the water baffle is to split part of the water flowing into the water discharging channel to enter the overflow pipe, so that the water entering the overflow pipe forms a water seal at the outlet of the overflow channel, thereby preventing the air in the overflow channel from colliding with the water flowing into the water discharging channel. It can be known from the foregoing that the actual function of the water baffle of CN 206503204U is to guide the water flow, so that the water flow from the water tank partially forms a water seal, and the remaining part maintains to be discharged. However, the aforementioned structure cannot provide the function of rapid water discharge. Moreover, there is a certain distance between the water baffle and the outlet of the overflow channel, and water flow cannot be specifically restricted. In view of the drawbacks of the aforementioned water discharging structure, the applicant of the invention made every effort to develop a water discharging structure that is more conducive to rapid water discharging.

SUMMARY OF THE INVENTION

A main object of the invention is to solve the problem that the conventional water discharging structure do not specifically reduce an air resistance during water discharging.

In order to achieve the above object, the invention provides a quick water discharging device of a toilet tank including a water discharging structure and a water stoppage structure. The water discharging structure includes a main pipe and an overflow manifold communicating with an inner space of the main pipe, the main pipe comprising a pipe body, an inclined surface located at one end of the pipe body, and a communication hole located on the pipe body and communicating with the overflow manifold. The water stoppage structure includes a rubber valve seat located at an end of the main pipe provided with the inclined surface, and a water stoppage valve pivotally connected to the overflow manifold and fitted with the rubber valve seat. The water stoppage valve is operated to be opened relative to the rubber valve seat. The inner space of the main pipe communicates with an external environment when the water stoppage valve is opened. The rubber valve seat includes a seat body matched with the inclined surface, an opening formed on the seat body and communicating with the inner space of the main pipe, and at least one baffle extending from the seat body to the inner space of the main pipe. The at least one baffle is close to an inner wall of the main pipe and faces the communication hole. The at least one baffle covers at least 50% of an area of the communication hole.

In one embodiment, the at least one baffle completely covers the communication hole.

In one embodiment, the at least one baffle includes a plane, and a working surface opposite to the plane and located on a side of the at least one baffle facing the communication hole.

In one embodiment, the working surface is divided into a straight section connected to the seat body, and an inclined section connected to the straight section and facing the communication hole.

In one embodiment, a thickness of the at least one baffle is tapered from the straight section toward the inclined section.

In one embodiment, the plane is devoid of a stage difference.

In one embodiment, the plane and the opening are located on a same plane.

In one embodiment, the at least one baffle is replaced by a stop ring.

In one embodiment, the seat body is formed with a water blocking surface contacting the water stoppage valve.

In one embodiment, the main pipe includes a convex rib disposed on the pipe body and located at the end of the main pipe provided with the inclined surface, and the rubber valve seat includes an assembly groove disposed on the seat body and matched with the convex rib.

In one embodiment, the rubber valve seat includes an assembly hook connected with the seat body and forming the assembly groove.

In one embodiment, the water stoppage valve includes a water stoppage upper cover covering the rubber valve seat and pivotally connected with the overflow manifold, a plurality of pivotal arms connecting the water stoppage upper cover, and a plug that moves with the water stoppage upper cover and is located in the opening when the water stoppage valve is not operated.

In one embodiment, the water stoppage valve includes an assembly fastener disposed on the water stoppage upper cover, and the plug is detached from the assembly fastener of the water stoppage upper cover.

In one embodiment, the water discharging structure includes a connecting pipe connecting the main pipe and the overflow manifold.

In one embodiment, an inner wall of the connecting pipe is formed with a diversion surface, and the diversion surface guides a fluid of the overflow manifold to flow toward the main pipe.

Through the aforementioned implementation of the invention, the invention has the following characteristics compared with the conventional technique: the invention provides the at least one baffle on the rubber valve seat, the at least one baffle is disposed close to the inner wall of the main pipe and covers at least 50% of an area of the communication hole; thereby the problem that the conventional structures cannot specifically reduce an air resistance during water discharging is improved. Furthermore, the rubber valve seat of the invention is changed from the conventional hard material to a soft rubber material, which facilitates assembling of the quick water discharging device and increases water discharging efficiency.

DETAILED DESCRIPTION OF THE PREFERRED EMBODIMENTS

Figure 1:
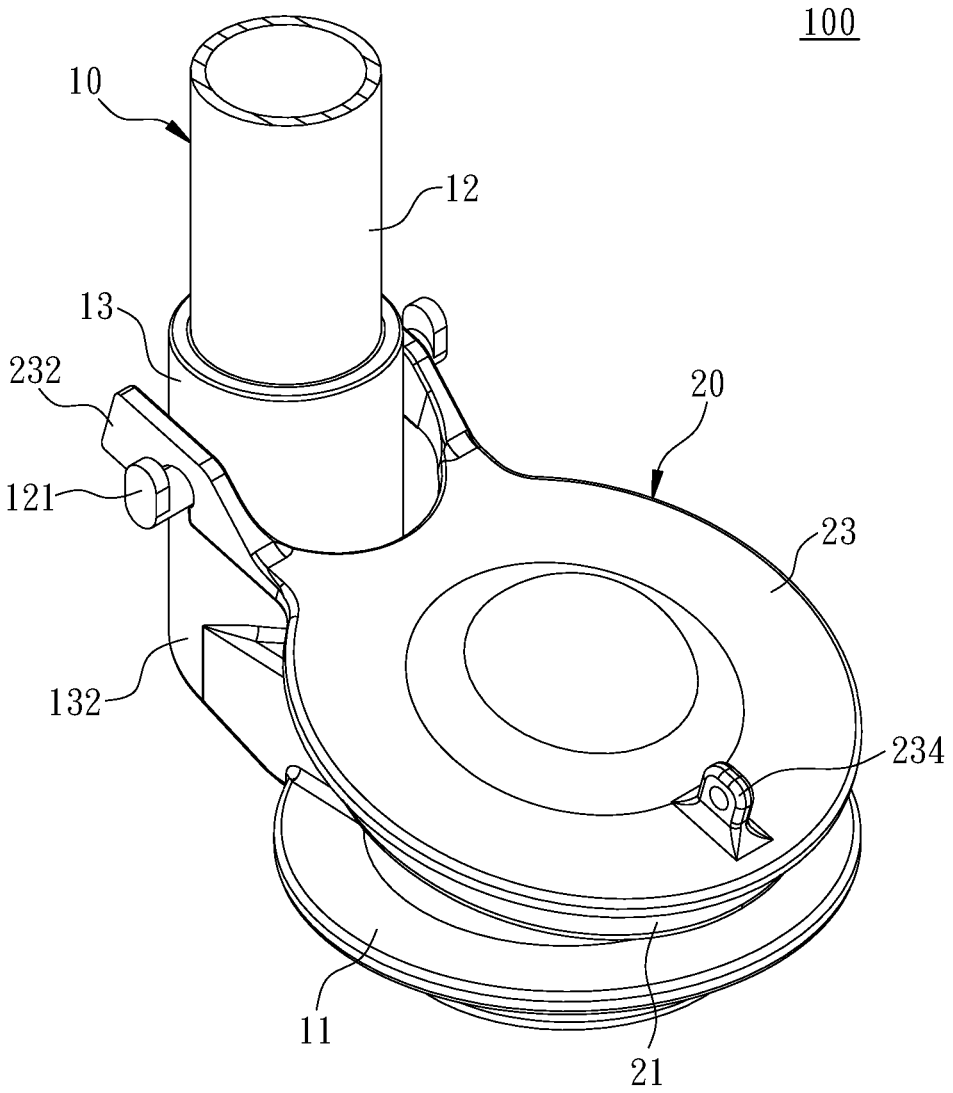
FIG. 1 is a perspective view of an embodiment of a quick water discharging device of a toilet tank of the invention.
Figure 2:
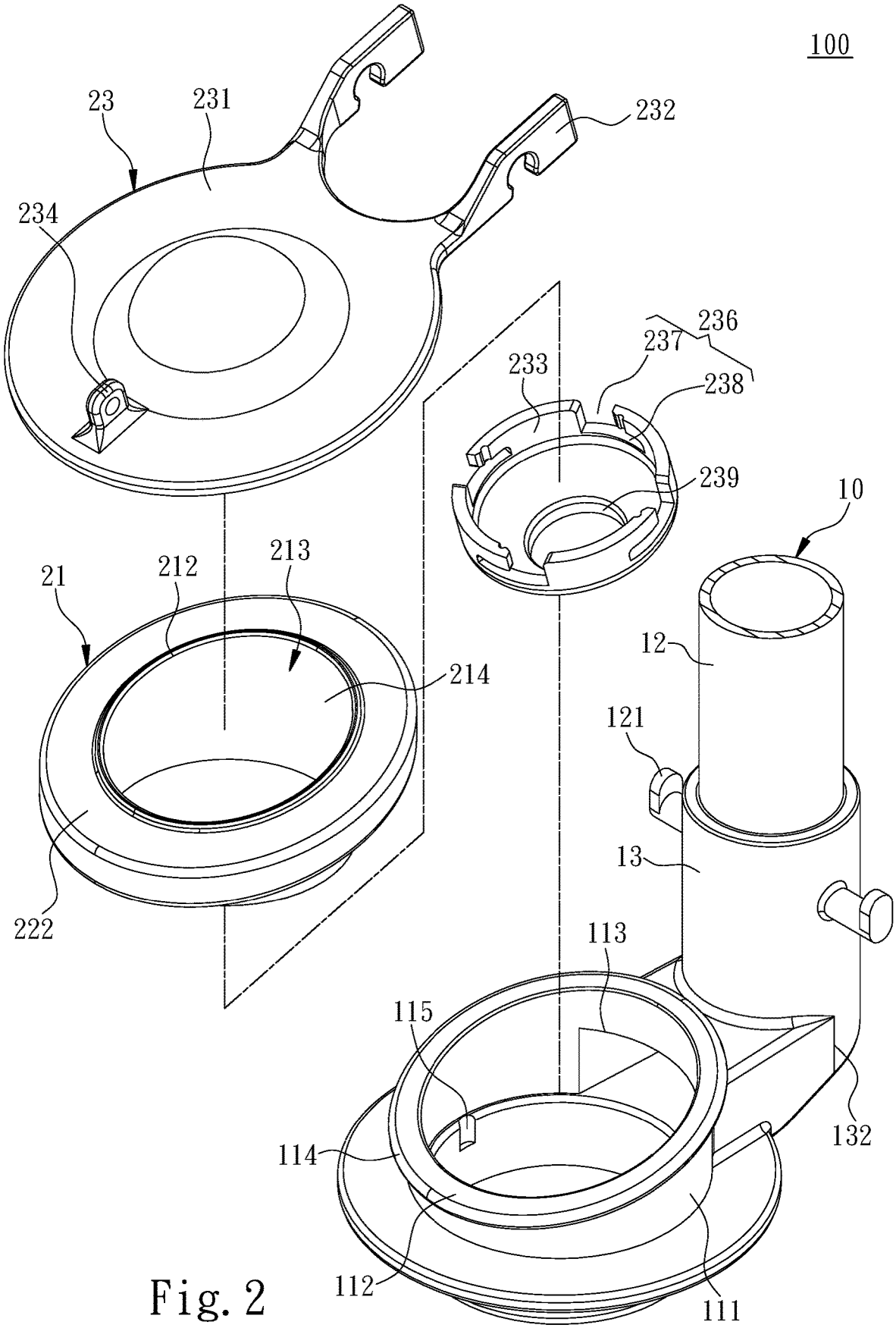
FIG. 2 is an exploded perspective view of the embodiment of the quick water discharging device of the toilet tank of the invention.
Figure 3:
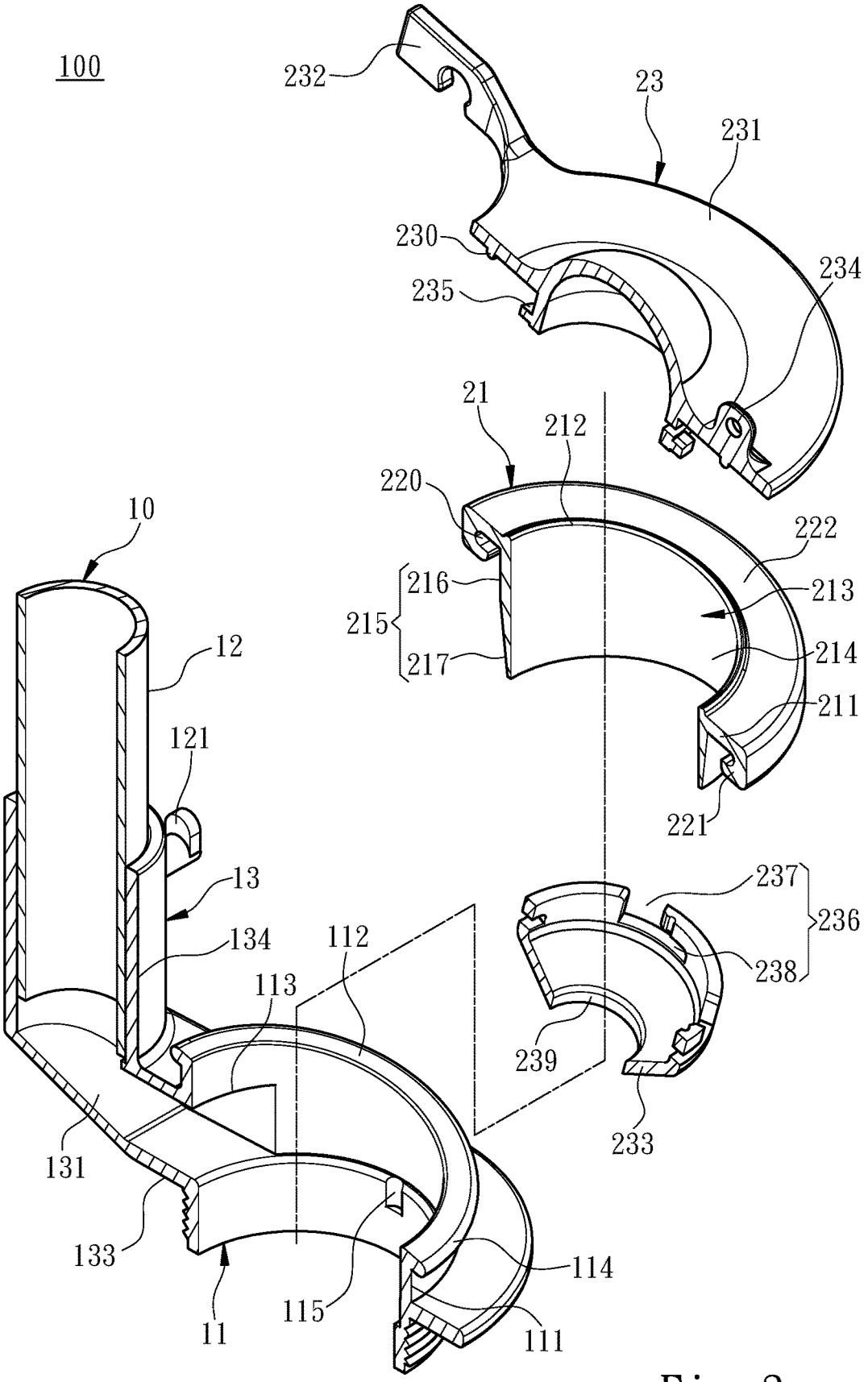
FIG. 3 is an exploded section view of the embodiment of the quick water discharging device of the toilet tank of the invention.

The detailed description and technical content of the invention are described below with reference to the accompanying drawings.

Please refer to FIG. 1, FIG. 2, FIG. 3, FIG. 4, FIG. 5, and FIG. 6, the invention provides a quick water discharging device 100. The quick water discharging device 100 is disposed in a toilet tank (not shown in the figures), and used to control water discharging of the toilet tank. The quick water discharging device 100 includes a water discharging structure 10 and a water stoppage structure 20. The water discharging structure 10 includes a main pipe 11 and an overflow manifold 12. The main pipe 11 is provided for water discharging. The overflow manifold 12 communicates with an inner space of the main pipe 11. Serving as a water level controller in the toilet tank, the overflow manifold 12 receives an inflow of water in the toilet tank with water level higher than a set water level and discharges water through the main pipe 11. Furthermore, the main pipe 11 includes a pipe body 111 communicating with the overflow manifold 12, an inclined surface 112 disposed at one end of the pipe body 111, and a communication hole 113 disposed on the pipe body 111 and communicating with the overflow manifold 12.

The water stoppage structure 20 includes a rubber valve seat 21 located at an end of the main pipe 11 provided with the inclined surface 112, and a water stoppage valve 23 pivotally connected to the overflow manifold 12. The water stoppage valve 23 fits with the rubber valve seat 21. The water stoppage valve 23 blocks communication through the rubber valve seat 21 when the water stoppage valve 23 is not operated, and restricts the main pipe 11 from communicating with an external environment. Once the water stoppage valve 23 is operated, the water stoppage valve 23 is opened relative to the rubber valve seat 21, and the inner space of the main pipe 11 communicates with the external when the water stoppage valve 23 is opened. Furthermore, the rubber valve seat 21 is made of rubber material, which is different from the conventional technique that utilizes the valve seat made of hard material. The rubber valve seat 21 includes a seat body 211 disposed above the pipe body 111, an opening 212 formed on the seat body 211, and at least one baffle 213 extending from the seat body 211 to the inner space of the main pipe 11. The seat body 211 matches with the inclined surface 112 and is obliquely assembled with the pipe body 111. The opening 212 communicates with the inner space of the main pipe 11 and faces the water stoppage valve 23. The opening 212 is closed when the water stoppage valve 23 is not opened relative to the rubber valve seat 21. The at least one baffle 213 is close to an inner wall of the main pipe 11 and faces the communication hole 113. The at least one baffle 213 does not completely close the communication hole 113. There is a gap between the at least one baffle 213 and the communication hole 113. A function of the at least one baffle 213 is to block resisting force of an air from the communication hole 113. The at least one baffle 213 covers at least 50% of an area of the communication hole 113 to achieve an effect of blocking air resistance.

Figure 4:
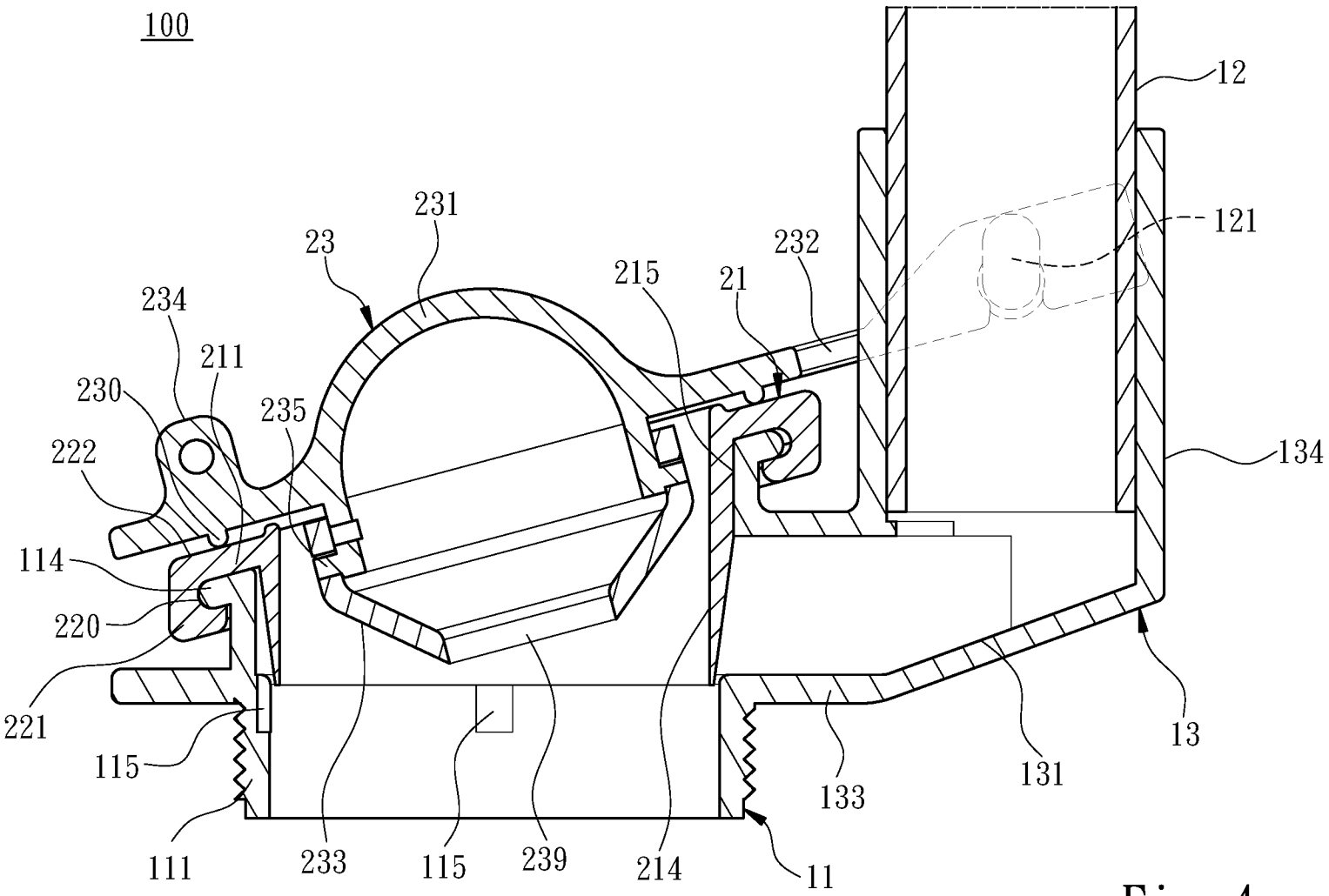
FIG. 4 is a cross-sectional side view of the embodiment of the quick water discharging device of the toilet tank of the invention.
Figure 5:
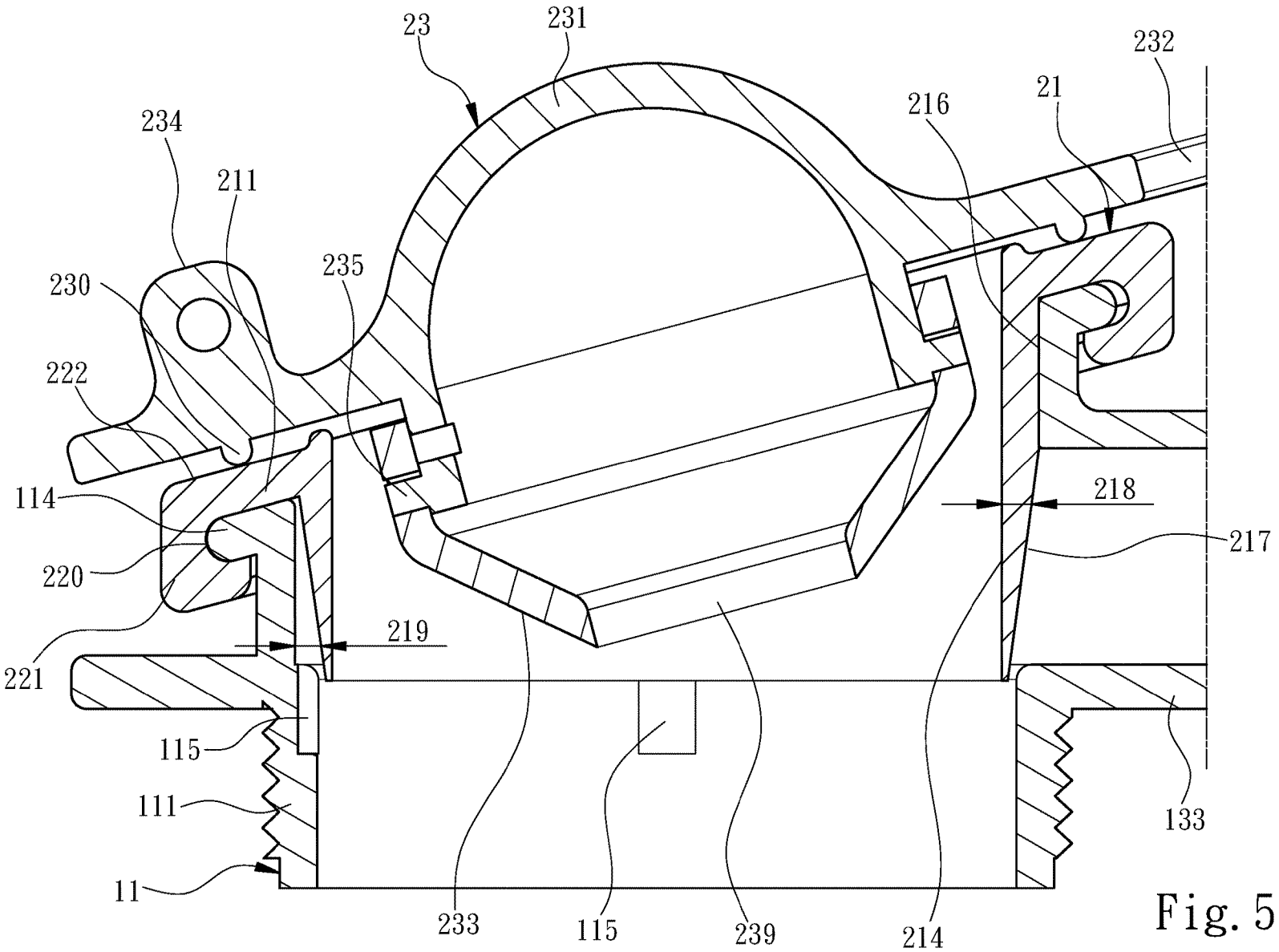
FIG. 5 is a partial section of the embodiment of the quick water discharging device of the toilet tank of the invention.
Figure 6:
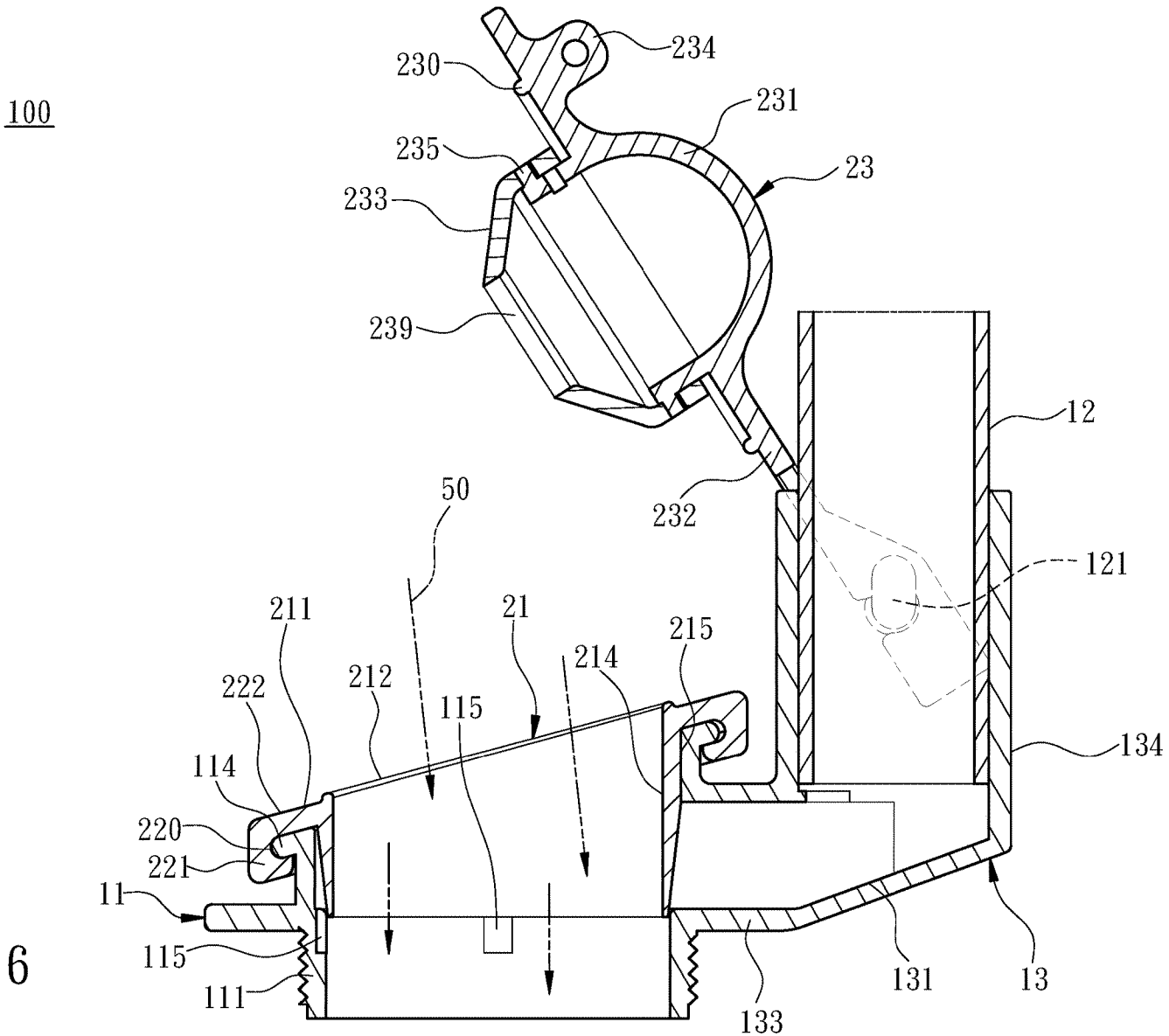
FIG. 6 is a cross-sectional operation diagram of the embodiment of the quick water discharging device of the toilet tank of the invention.

Please refer to FIG. 4, FIG. 5, and FIG. 6, implementation of the quick water discharging device 100 is described hereinafter. In an initial state, the water stoppage valve 23 is not operated and closes the opening 212, thereby blocking the inner space of the main pipe 11 to communicate with the external, as shown in FIG. 4. When the water stoppage valve 23 is operated, the water stoppage valve 23 pivots and is opened relative to the rubber valve seat 21, and the water stoppage valve 23 unblocks the opening 212, so that the inner space of the main pipe 11 communicates with the external, allowing water in the water tank to enter the main pipe 11 (as labeled in numeral "50"). At this point, the overflow manifold 12 discharges air towards the communication hole 113, the at least one baffle 213 blocks an air resistance from the communication hole 113 under an action of water pressure, so that water enters and discharges from the inner space of the main pipe 11 smoothly. When the water stoppage valve 23 pivots again and closes the opening 212, the water stoppage valve 23 blocks communication of the main pipe 11 with the external. At this moment, since the at least one baffle 213 does not completely close the communication hole 113, the overflow manifold 12 is in communication with the main pipe 11, and the overflow manifold 12 still provides water flowing therein to flow into the main pipe 11 through the communication hole 113 when the water stoppage valve 23 is not opened.

Accordingly, the invention provides the at least one baffle 213 on the rubber valve seat 21, the at least one baffle 213 is disposed close to the inner wall of the main pipe 11 and covers at least 50% of an area of the communication hole 113; thereby the problem that the conventional structures do not specifically reduce an air resistance during water discharging is solved. Furthermore, the rubber valve seat 21 of the invention is changed from the conventional hard material to a soft rubber material, which facilitates assembling of the quick water discharging device 100 and increases water discharging efficiency.

In one embodiment, in order to enhance an air blocking effect of the at least one baffle 213, the at least one baffle 213 completely covers the communication hole 113. Viewing a section of the at least one baffle 213 shown in FIG. 4, a lower edge of the at least one baffle 213 at least reaches a bottom end of the communication hole 113. The communication hole 113 is completely covered by the at least one baffle 213, and a user is disabled to look into the communication hole 113 from outside. It should be noted that, in this embodiment, the at least one baffle 213 does not close the communication hole 113, the at least one baffle 213 is only disposed near the communication hole 113 and covers the communication hole 113. In another embodiment, in order to enhance an effect of blocking air resistance, a plurality of baffles 213 are provided, and the plurality of baffles 213 are disposed around the inner wall of the main pipe 11. In another embodiment, the at least one baffle 213 is replaced by a stop ring.

Please refer to FIG. 1, FIG. 2, FIG. 3, FIG. 4, FIG. 5, and FIG. 6, the at least one baffle 213 of the invention includes a plane 214 and a working surface 215. The plane 214 is located on a side of the at least one baffle 213 facing the opening 212, and the plane 214 receives water flowing from the opening 212. In order to increase the smoothness of water flow in the invention, in one embodiment, the plane 214 has no stage difference and is devoid of a stage difference. In another embodiment, the plane 214 and the opening 212 are located on a same plane. The working surface 215 is opposite to the plane 214 and is located on an other side of the at least one baffle 213 facing the communication hole 113. The working surface 215 receives water flowing from the communication hole 113. In one embodiment, the working surface 215 is divided into a straight section 216 connected to the seat body 211, and an inclined section 217 connected to the straight section 216. The inclined section 217 faces the communication hole 113. One end of the inclined surface 112 not connected to the straight section 216 is inclined away from the communication hole 113. In another embodiment, when the plane 214 is vertically disposed, a thickness 218 of the at least one baffle 213 is tapered from the straight section 216 toward the inclined section 217. In the embodiment that the at least one baffle 213 is replaced by the stop ring, a distance 219 between the stop ring and the inner wall of the main pipe 11 is tapered from an end of the stop ring opposite to the seat body 211 toward an end of the stop ring adjoined to the seat body 211.

In one embodiment of the invention, to stabilize disposition of the rubber valve seat 21 on the pipe body 111, the main pipe 11 includes a convex rib 114 disposed on the pipe body 111. The rubber valve seat 21 comprises an assembly groove 220 provided on the seat body 211. The convex rib 114 is located at the end of the main pipe 11 provided with the inclined surface 112. The assembly groove 220 is matched with the convex rib 114. The assembly groove 220 is located at a position where the rubber valve seat 21 and the main pipe 11 are assembled with each other. Further, the rubber valve seat 21 includes an assembly hook 221 connected with the seat body 211. The assembly hook 221 and the seat body 211 jointly form the assembly groove 220. The rubber valve seat 21 contacts the main pipe 11 when assembled with the main pipe 11.

Please refer to FIG. 1, FIG. 2, FIG. 3, FIG. 4, FIG. 5, and FIG. 6, in one embodiment, the seat body 211 is formed with a water blocking surface 222. The water blocking surface 222 matches and contacts the water stoppage valve 23 to provide a water blocking function with the water stoppage valve 23. In one embodiment, the water stoppage valve 23 forms a water blocking ring 230 in contact with the water blocking surface 222. The water blocking ring 230 and the water blocking surface 222 restrict water flow when the water blocking ring 230 is in contact with the water blocking surface 222. The water stoppage valve 23 includes a water stoppage upper cover 231, a plurality of pivotal arms 232 and a plug 233. The water stoppage upper cover 231 covers the rubber valve seat 21 and is pivotally connected with the overflow manifold 12. The water stoppage upper cover 231 contacts the water blocking surface 222 when the water stoppage upper cover 231 is not opened relative to the rubber valve seat 21. The water stoppage upper cover 231 and the water blocking surface 222 are provided for blocking water. Moreover, in order to make ensure operation of the water stoppage valve 23, the water stoppage valve 23 includes at least one lug 234 located on the water stoppage upper cover 231, and the at least one lug 234 is provided for assembling with an external device (not shown in the figures) so that the external device is operated to drive movement of the water stoppage upper cover 231. In addition, the plurality of pivotal arms 232 are connected with the water stoppage upper cover 231 and the overflow manifold 12. The plurality of pivotal arms 232 is provided for the water stoppage upper cover 231 to pivot relative to the overflow manifold 12. In one embodiment, the overflow manifold 12 is provided with a plurality of assembly blocks 121 to assemble with the plurality of pivotal arms 232.

The plug 233 is disposed on a side of the water stoppage upper cover 231 facing the rubber valve seat 21. The plug 233 moves with the water stoppage upper cover 231. In detail, the plug 233 is located in the opening 212 when the water stoppage valve 23 is not opened relative to the rubber valve seat 21. The plug 233 is detached from the opening 212 when the water stoppage valve 23 is opened relative to the rubber valve seat 21. Further, the plug 233 is detachable, that is, the plug 233 is optionally assembled with the water stoppage upper cover 231. In one embodiment, the water stoppage valve 23 includes an assembly fastener 235 disposed on the water stoppage upper cover 231. The plug 233 is formed with at least one assembly groove 236 connected with the assembly fastener 235. The plug 233 is detachable from the assembly fastener 235 of the water stoppage upper cover 231. In addition, the at least one assembly groove 236 is divided into an open section 237 for the assembly fastener 235 to insert therein, and a restricting section 238 connected to the open section 237 and restricting the assembly fastener 235 from being separated. In another embodiment, the plug 233 is formed with at least one through hole 239 located on a side of the plug 233 opposite to the water stoppage upper cover 231.

Please refer to FIG. 1, FIG. 2, FIG. 3, FIG. 4, FIG. 5, and FIG. 6, in one embodiment, the water discharging structure 10 includes a connecting pipe 13, the connecting pipe 13 connects the main pipe 11 and the overflow manifold 12. The connecting pipe 13 communicates with the communication hole 113 of the main pipe 11 and the overflow manifold 12. Further, in the invention, in order to guide water flowing toward the main pipe 11 through the connecting pipe 13, an inner wall of the connecting pipe 13 is formed with a diversion surface 131, and the diversion surface 131 is inclined towards the communication hole 113, so that water fluid of the overflow manifold 12 flow toward the main pipe 11. In another embodiment, the main pipe 11 and the overflow manifold 12 are disposed vertically, and the connecting pipe 13 includes a bend 132 for connecting the main pipe 11 and the overflow manifold 12. More specifically, the connecting pipe 13 includes a transverse section 133 connected to the main pipe 11 and a longitudinal section 134 connected to the transverse section 133 and bent relative to the transverse section 133. The longitudinal section 134 is connected to the overflow manifold 12. At least one notch 115 is formed on the inner wall of the main pipe 11. Water from the overflow manifold 12 enters the at least one notch 115, flows along a gap between the main pipe 11 and the rubber valve seat 21, and is discharged. In one embodiment, a plurality of notches 115 are provided.

What is claimed is:

1. A quick water discharging device of a toilet tank, comprising:

a water discharging structure, comprising a main pipe and an overflow manifold communicating with an inner space of the main pipe, the main pipe comprising a pipe body, an inclined surface located at one end of the pipe body, and a communication hole located on the pipe body and communicating with the overflow manifold; and a water stoppage structure, comprising a rubber valve seat located at an end of the main pipe provided with the inclined surface, and a water stoppage valve pivotally connected to the overflow manifold and fitted with the rubber valve seat, the water stoppage valve operated to be opened relative to the rubber valve seat, the inner space of the main pipe communicating with an external environment when the water stoppage valve is opened, the rubber valve seat comprising a seat body matched with the inclined surface, an opening formed on the seat body and communicating with the inner space of the main pipe, and at least one baffle extending from the seat body to the inner space of the main pipe, the at least one baffle being close to an inner wall of the main pipe and facing the communication hole, and the at least one baffle covering at least 50% of an area of the communication hole, wherein the at least one baffle is configured to, when the water stoppage valve unblocks the opening to allow water in the toilet tank to enter the main pipe, block an air resistance from the communication hole under an action of water pressure, and the at least one baffle is configured to, when the water stoppage valve closes the opening, not completely close the communication hole, such that the overflow manifold is in communication with the main pipe.

2. The quick water discharging device of the toilet tank as claimed in claim 1, wherein the at least one baffle completely covers the communication hole.

3. The quick water discharging device of the toilet tank as claimed in claim 1, wherein the at least one baffle comprises a plane, and a working surface opposite to the plane and located on a side of the at least one baffle facing the communication hole.

4. The quick water discharging device of the toilet tank as claimed in claim 3, wherein the working surface is divided into a straight section connected to the seat body, and an inclined section connected to the straight section and facing the communication hole.

5. The quick water discharging device of the toilet tank as claimed in claim 4, wherein a thickness of the at least one baffle is tapered from the straight section toward the inclined section.

6. The quick water discharging device of the toilet tank as claimed in claim 5, wherein the plane is devoid of a stage difference.

7. The quick water discharging device of the toilet tank as claimed in claim 6, wherein the plane and the opening are located on a same plane.

8. The quick water discharging device of the toilet tank as claimed in claim 1, wherein the at least one baffle is in a shape of ring.

9. The quick water discharging device of the toilet tank as claimed in claim 1, wherein the seat body is formed with a water blocking surface contacting the water stoppage valve.

10. The quick water discharging device of the toilet tank as claimed in claim 9, wherein the main pipe comprises a convex rib disposed on the pipe body and located at the end of the main pipe provided with the inclined surface, and the rubber valve seat comprises an assembly groove disposed on the seat body and matched with the convex rib.

11. The quick water discharging device of the toilet tank as claimed in claim 10, wherein the rubber valve seat comprises an assembly hook connected with the seat body and forming the assembly groove.

12. The quick water discharging device of the toilet tank as claimed in claim 1, wherein the water stoppage valve comprises a water stoppage upper cover covering the rubber valve seat and pivotally connected with the overflow manifold, a plurality of pivotal arms connecting the water stoppage upper cover, and a plug that moves with the water stoppage upper cover and is located in the opening when the water stoppage valve is not operated.

13. The quick water discharging device of the toilet tank as claimed in claim 12, wherein the water stoppage valve comprises an assembly fastener disposed on the water stoppage upper cover, and the plug is detachable from the assembly fastener of the water stoppage upper cover.

14. The quick water discharging device of the toilet tank as claimed in claim 1, wherein the water discharging structure comprises a connecting pipe connecting the main pipe and the overflow manifold.

15. The quick water discharging device of the toilet tank as claimed in claim 14, wherein an inner wall of the connecting pipe is formed with a diversion surface, and the diversion surface guides a fluid of the overflow manifold to flow toward the main pipe.

* * * * *